3/6/84 XR 4,435,696

United States Patent [19]

Gould et al.

[11] 4,435,696

[45] Mar. 6, 1984

[54] VISOR ASSEMBLY FOR PEDESTRIAN TRAFFIC SIGNAL

[75] Inventors: Samuel Gould, San Pedro; James S. Gould, Los Alamitos, both of Calif.

[73] Assignee: Indicator Controls Corporation, Gardena, Calif.

[21] Appl. No.: 305,452

[22] Filed: Sep. 25, 1981

[51] Int. Cl.[3] ..... E01F 9/00; F21V 17/00

[52] U.S. Cl. ..... 340/119; 340/87; 340/815.32; 340/944; 40/554; 40/577; 116/63 R; 362/186; 362/376; 362/358; 362/359; 350/268; 350/276 R

[58] Field of Search ..... 362/290, 292, 376, 358, 362/359, 186; 340/119, 122, 84, 87, 103, 107, 108, 44, 815.15, 815.16, 815.2, 815.32; 116/63 R, 63 P; 40/557, 560, 564, 573, 574, 579, 580, 612; 350/399, 401, 404, 406

[56] References Cited

U.S. PATENT DOCUMENTS 4,240,063 12/1980 Gould et al. ..... 340/119

*Primary Examiner*—Donnie L. Crosland

*Attorney, Agent, or Firm*—Keith D. Beecher

[57] ABSTRACT

A visor assembly for a pedestrian traffic signal, which is intended to be mounted across the face of the signal and which serves to screen the signal from sunlight. The visor assembly of the invention includes a frame, and a grating mounted in the frame. The grating is formed of a plurality of zig-zag strips and straight strips interposed between one another, and adhesively attached to one another, so as to provide a solid grating which is locked into the frame, and which cannot be pried out of the frame by vandals.

5 Claims, 6 Drawing Figures

VISOR ASSEMBLY FOR PEDESTRIAN TRAFFIC SIGNAL

BACKGROUND

The visor assembly of the present invention is of the general type described, for example, in U.S. Pat. No. 3,863,251 which issued Jan. 28, 1975, and which is assigned to the present assignee. It has been found that visor assemblies of the type described in the patent are subject to widespread vandalism, the vandalism involving twisting and pulling the grating out of the frame. Many attempts have been made in the past to render the visor assemblies proof against such vandalism, one such attempt being disclosed in U.S. Pat. No. 4,240,063, which issued Dec. 16, 1980, and which also is assigned to the present assignee. However, these attempts have been only partially successful.

Accordingly, the principal objective of the present invention is to provide such a visor assembly which is virtually proof from vandalism, and yet which may be constructed and assembled with relative ease and simplicity.

RELATED COPENDING APPLICATION

Ser. No. 270,589 filed June 4, 1981 now U.S. Pat. No. 4,385,284.

DETAILED DESCRIPTION OF THE ILLUSTRATED EMBODIMENT

Figure 1:
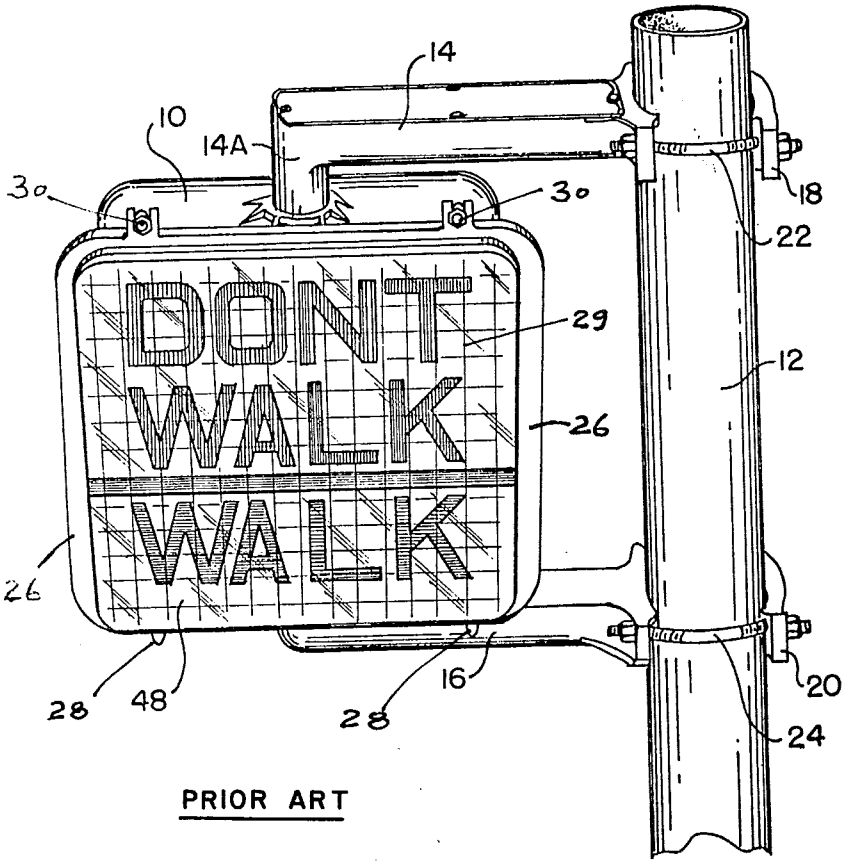
FIG.1 PRIOR ART
FIG. 1 is a perspective representation of a typical prior art pedestrian traffic control signal, and of a typical prior art visor assembly mounted over the face of the signal.

As shown in FIG. 1, a rectangular-shaped pedestrian signal case 10 is mounted on a hollow upright supporting pole 12 by a pair of elongated brackets 14 and 16. The elongated brackets each have an integral protuberance, such as protuberance 14A, at the distal ends thereof, and these protuberances extend into mounting holes in the upper and lower sides of the case 10, the protuberances being attached to the case by appropriate fastening means. Brackets 14 and 16 are supported on pole 21 by shoes, such as the shoes 18 and 20, and by bolts, such as bolts 22 and 24 which extend between the ends of the brackets 14, 16 and the shoes 18, 20. In the illustrated embodiment the bolts 22 and 24 have an arcuate configuration to extend partially around the peripheral surfae of the pole. The illustrated configuration of the bolts is advantageous in that it permits the pedestrian signal unit to be turned around the axis of the pole to square it with the crosswalk before the bolts 22, 24 are tightened.

The signal includes a usual door frame 26 hinged to the case 10 by hinges 28 and held shut by bolts 30. As is well known, appropriate light sources are mounted within case 10, and these light sources are selectively energized so as to illuminate the legend "WALK" on the lower portion of the face plate 48, or the legends "DONT WALK" on the upper portion of the face plate.

As fully described in U.S. Pat. No. 3,863,251, referred to above, a visor 29 is mounted in door frame 26 in front of the face plate 48 of the signal which bears the legends "WALK" and "DONT WALK". The visor 29 consists of a grating which is formed of a plurality of strips, or louvers, of appropriate metal or plastic material which define a multiplicity of openings. The louvers serve to blank out the legends "WALK" and "DONT WALK" when the corresponding light sources within the pedestrian signal are de-energized, this being achieved by minimizing the reflections on the external surface of the screen, even in the presence of strong incident sunlight. In this manner, there is no danger of anyone misreading the pedestrian signal, since the legends are visible only when the corresponding light sources are energized.

Figure 5:
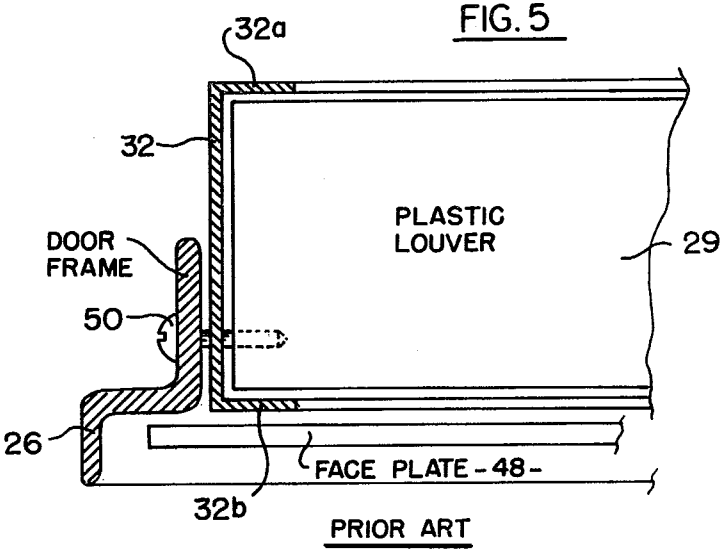
FIG. 5 PRIOR ART
FIG. 5 is a framentary sectional view of the prior art assembly of FIG. 1.

The visor 29 includes a frame 32 (FIG. 5) formed, for example, of aluminum which, in turn, has a front rim **32*a* and a rear rim 32*b*, each extending around the periphery of the frame. The frame 32 is secured to the door frame 26 by screws, such as screw 50, as shown in FIG. 5. To mount the prior art visor 48 in frame 32**, the visor is fitted into the frame from the front of the signal.

In accordance with the present invention, the visor 29' is formed of a plurality of straight strips, or louvers, 34 and zig-zag strips 36 (FIGS. 2 and 3), the ends of which extend under the rim **32'*a* of the frame 32' (FIGS. 2, 4 and 6), so that the louvers may be firmly held within the frame. The louvers 34 and 36 which make up the visor are composed of approriate plastic material such as "Lexan", and they are welded or adhesively attached to one another, so that the entire visor is one solid piece, which cannot be removed from the frame 32'** under any normal circumstances, so that the assembly is not subject to vandalism.

Figure 2:
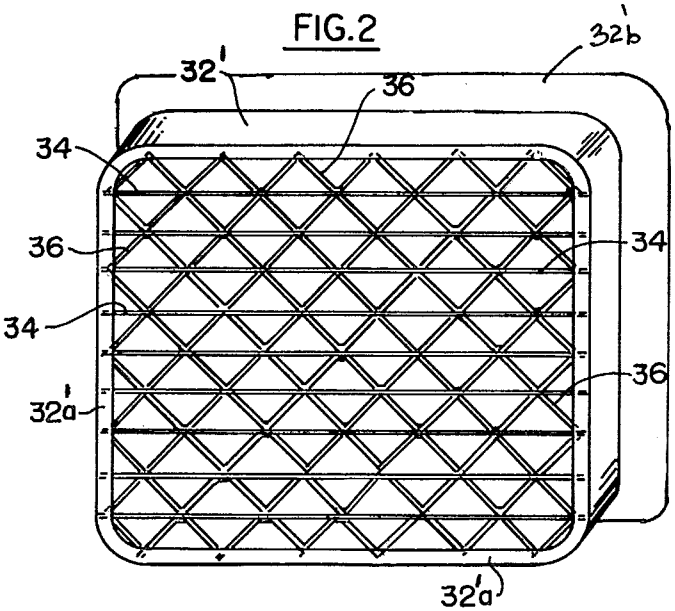
FIG. 2 is a perspective representation of a visor assembly constructed in accordance with the present invention.
Figure 3:
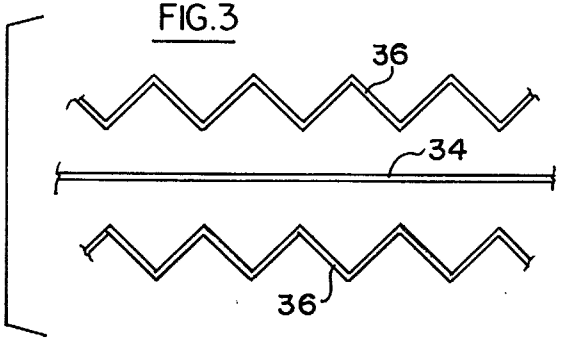
FIG. 3 is a front view of various elements included in the visor assembly of FIG. 2.
Figure 6:
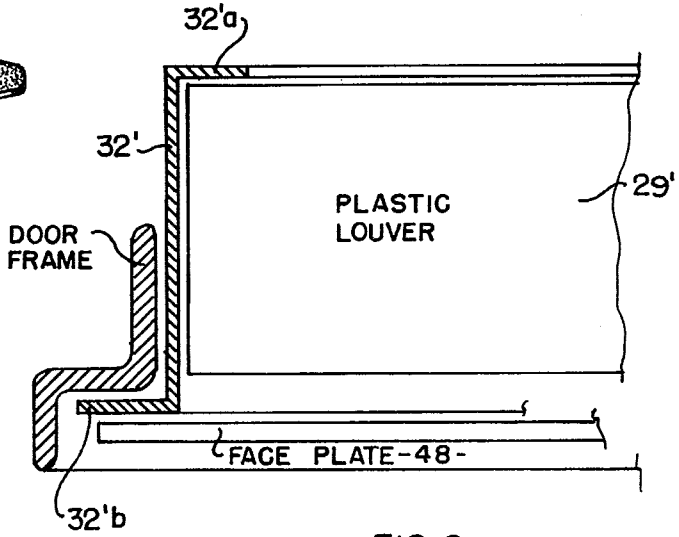
FIG. 6 is a corresponding fragmentary section of the visor assembly of the invention.
Figure 4:
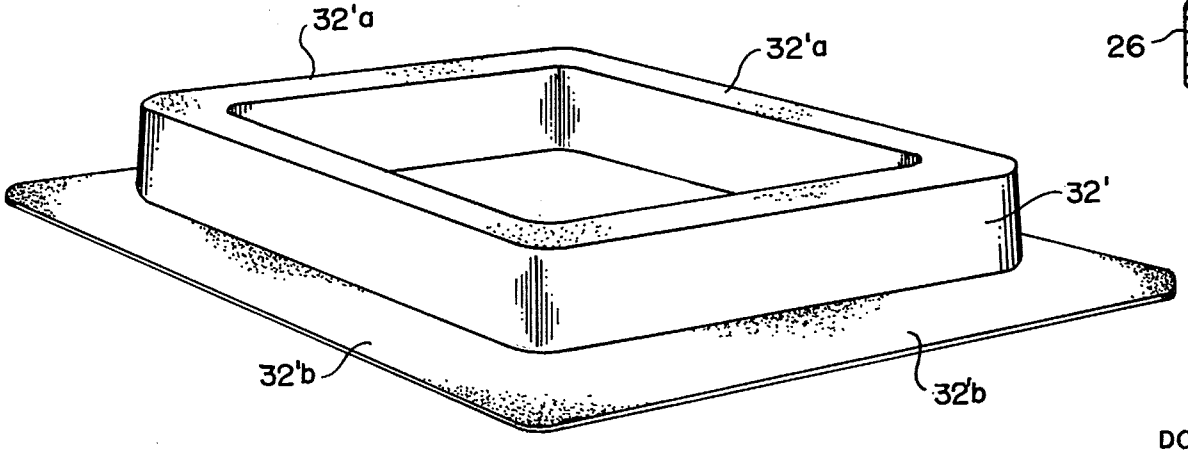
FIG. 4 is a perspective view of a frame for the visor of the invention.

The inner rim **32'*b* of frame 32' extends outwardly, as shown in FIGS. 2, 4 and 6. Frame 32' may be a vacuum formed frame of suitable plastic material. The solid visor 29' is inserted into the frame 32' from the rear of door frame 26. The frame 32' and visor 29' are securely mounted on door frame 50, as shown in FIG. 6**, without the need for mounting screws.

Although a particular embodiment of the invention has been shown and descried, modifications may be made, and it is intended in the following claims to cover all modifications which come within the spirit and scope of the invention.

What is claimed is:

1. In combination with a pedestrian traffic signal having a housing, and having legends selectively illuminated by light sources within the housing; a frame mounted on the housing in front of the legends, said frame having a forward end and having a rim portion extending inwardly in coplanar relationship with the forward end of the frame; and a visor mounted in the frame composed of a set of straight strips extending across the frame in mutually spaced and parallel relationship, said straight strips having ends extending under said rim portion, and a plurality of zigzag strips extending across said frame between corresponding ones of said straight strips and between the top and bottom of said frame and said straight strips, said zigzag strips having ends and apexes, the ends of said zigzag strips extending under said rim portions of said frame, and the apexes of certain ones of said zigzag strips extending under said rim portion at the top and bottom of said frame, said zigzag strips and said straight strips being attached to one another.

2. The combination defined in claim 1, in which said zig-zag strips and said straight strips are adhesively bonded to one another.

3. The combination defined in claim 1, in which said zig-zag strips and said straight strips are welded to one another.

4. The combination defined in claim 1, and which includes a door frame attached to the front of said housing for mounting said frame and visor on said signal.

5. The combination defined in claim 4, in which said frame has a second rim extending outwardly from the perimeter of the frame in coplanar relationship with the rear end of said frame, said second rim extending under said door frame to mount said frame and visor on said signal.

* * * * *